United States Patent [19]
Egbers et al.
[11] 4,318,269
[45] Mar. 9, 1982

[54] PROCESS AND APPARATUS FOR PIECING-UP A WRAP YARN

[75] Inventors: Gerhard Egbers; Peter Artzt, both of Reutlingen; Karl Brosch, Ebersbach-Weiler; Hans Rottmayr, Reutlingen, all of Fed. Rep. of Germany

[73] Assignee: Schubert and Salzer, Ingolstadt, Fed. Rep. of Germany

[21] Appl. No.: 172,298

[22] Filed: Jul. 25, 1980

[30] Foreign Application Priority Data

Jul. 28, 1979 [DE] Fed. Rep. of Germany ..... 2930798

[51] Int. Cl.[3] ..... B65H 81/08; D02G 3/36; D01H 15/00

[52] U.S. Cl. ..... 57/18; 57/261

[58] Field of Search ..... 57/6, 16–19, 57/261–263, 279, 353

[56] References Cited

U.S. PATENT DOCUMENTS

| | | | |
|---|---|---|---|
| 2,886,941 | 5/1959 | Bahnson, Jr. | 57/353 |
| 3,899,867 | 8/1975 | Northup et al. | 57/18 |
| 4,170,101 | 10/1979 | Bock | 57/261 X |
| 4,226,077 | 10/1980 | Hilbert | 57/18 |

*Primary Examiner*—Donald Watkins
*Attorney, Agent, or Firm*—Bailey, Dority & Flint

[57] ABSTRACT

A method and apparatus for piecing up yarn on an apparatus for producing wrap yarn. The device includes delivery rolls, a hollow spindle, takeup rolls, and a wind up device. A binding thread is fed from a bobbin carried on the hollow spindle for wrapping around a fiber bundle being fed through the delivery rolls and the hollow spindle. A clamping device and yarn guide is provided for positioning a piecing thread into the nip of the delivery rolls for being joined with said fiber bundle upon breaking of the wrap yarn.

9 Claims, 4 Drawing Figures

PROCESS AND APPARATUS FOR PIECING-UP A WRAP YARN

BACKGROUND OF THE INVENTION

The invention relates to a process for piecing-up a wrapped yarn which is produced by means of a hollow spindle from a spinning fiber bundle and a binding thread. A pair of delivery rolls of a drafting device feeds the spinning fiber bundle to the hollow spindle where the binding thread supplied from a binding thread bobbin is wrapped therearound. The wrapped yarn is drawn out of the hollow spindle and wound on a yarn bobbin.

It has previously been proposed for piecing-up during the production of wrap yarn to suck the untwisted spinning fiber bundle emerging from a pair of delivery rolls of a drafting apparatus into a hollow spindle by means of a compressed air gun, the binding thread being wound around and reinforcing the spinning fiber bundle (DE-OS No. 2,482,483). According to a further prior art proposal, the spinning fiber bundle is to be introduced from the pair of delivery rolls into the inlet opening of the hollow spindle with the aid of a feed tube supplied with compressed air (DE-OS No. 1,685,881).

Common to both proposals is the disadvantage that the piecing up of the spinning fiber bundle, which is liable to break as it is drawn along, is not guaranteed. Thus, in the first-mentioned process, it can occur that the speed of the compressed air in the gun is so high that the spinning fiber bundle is not bound in by the binding thread, or that, on the other hand, the reduced pressure produced in the hollow spindle is too small so that the binding thread is not drawn off from its bobbin. Difficulties arise with the reinforcement of the spinning fiber bundle and the introduction into the hollow spindle, jeopardizing the success of the piecing even when a feed tube supplied with compressed air is used.

SUMMARY OF THE INVENTION

An object of the invention is to provide a process and an apparatus which facilitate piecing of yarn in a simple and reliable manner.

This object is attained according to the invention in that, after stopping the hollow spindle and/or the binding thread bobbin and interruption of the yarn takeoff, a piecing thread introduced through the hollow spindle is slidably clamped above the delivery roll pair, and the piecing thread is then introduced into the nip of the pair of delivery rolls and is at the same time united with the spinning fiber bundle. The hollow spindle and/or the binding thread bobbin are set into operation and the piecing thread is drawn out of the hollow spindle overcoming the clamping force exerted on the yarn.

The wrap yarn and/or the binding thread is advantageously used as the piecing thread. In order to prevent thick places in the finished wrap yarn due to piecing, the piecing yarn drawn out of the hollow spindle is sucked out.

The apparatus for carrying out the process includes a pair of delivery rolls containing a driven bottom roll and a pressure roll, followed by a hollow spindle on which are arranged a binding thread bobbin, a takeoff roll pair and a windup device. Arranged above the pressure roll is a thread clamp and a thread guide yoke which extends in the direction of the nip at the free end side of the pressure roll.

In order to give the piecing yarn a better hold on the thread guide yoke, a restraining spring for the piecing thread is associated with the thread guide yoke. Sucking the piecing thread away is facilitated by a suction duct which follows the hollow spindle.

DESCRIPTION OF THE PREFERRED EMBODIMENT

Figure 1:
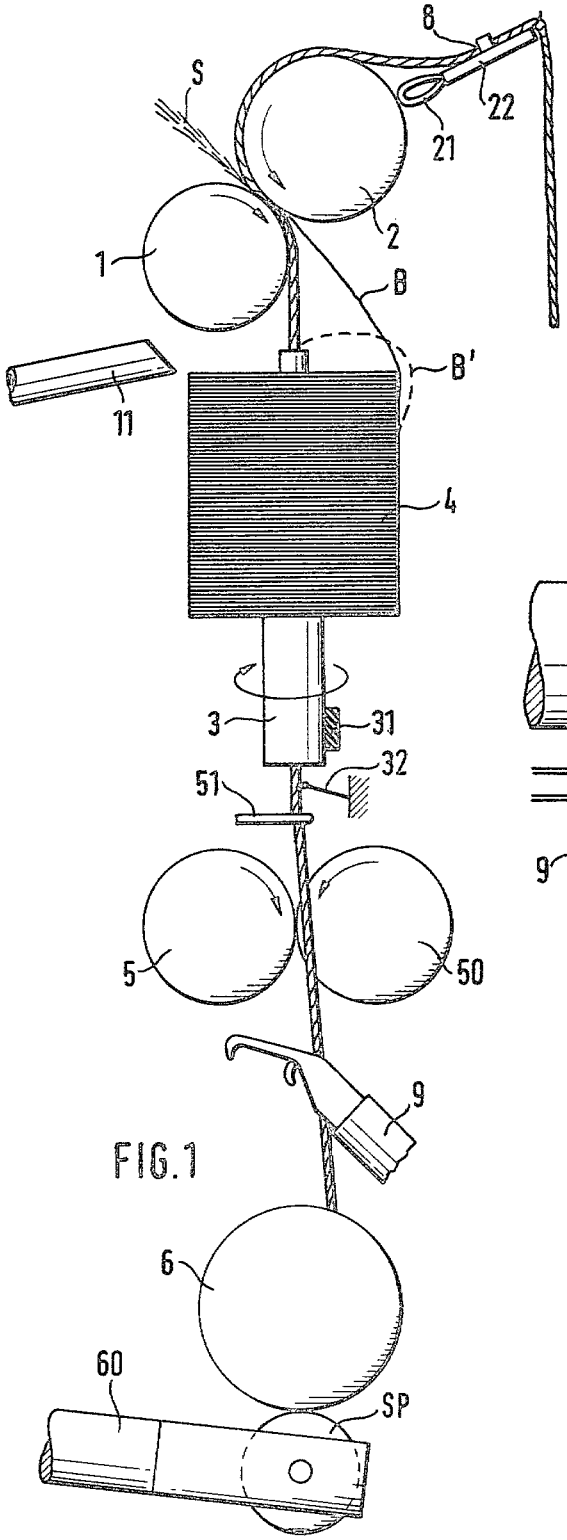
FIG. 1 is a side view of an apparatus constructed in accordance with the invention producing a wrap yarn with a piecing thread laid out at the spinning position.

According to FIG. 1, a drafting apparatus of which only a pair of delivery rolls with a driven bottom roll 1 and a pressure roll 2 being shown, is followed by a hollow spindle 3 which is rotatably mounted in the machine frame and is continuously driven, for example, by a tangential belt 31. As is clear from FIG. 2, the pressure roll 2 is arranged in the usual manner on a shaft 20, the other end of which carries a second pressure roll (not shown) which is associated with the adjacent spinning position. The shaft 20 is mounted centrally in a pressure arm (not shown). The cleaning of the pressure roll 2 of adhering fibers is effected by a stripper lip 21 which is held in a mounting 22 attached to the machine frame above the pressure roll 2. A suction tube 11 is associated with the pair of delivery rolls.

On the hollow spindle is a bobbin which contains a binding thread B, referred to hereafter as the binding thread bobbin 4. The binding thread bobbin 4 is fixed to the hollow spindle. It can, however, also be rotatably mounted on the hollow spindle 3 and be prevented from rotating with the hollow spindle during normal operation. The hollow spindle is followed by a pair of takeoff rolls 5, 50 and a windup apparatus for the finished wrap yarn. The takeoff rolls 50 are mounted pair-wise in a carrying and loading arm 52 (FIG. 3) and are pressed by this against the driven takeoff roll 5. The windup apparatus contains a grooved drum 6, by which the thread bobbin SP, held in a bobbin holder 60 and pressed, for example, by spring pressure against the grooved drum, is driven by friction.

For piecing, a thread guide yoke 7 is arranged on the end face of the pressure roll 2 remote from the mounting point of the shaft 20, one end of the yoke is appropriately attached to a mounting 22 of the stripper lip 21, and the other free end is adjacent to the nip formed by the bottom roll 1 and the pressure roll 2. Appropriately, a restraining spring 71 for the piecing thread is associated with the thread guide yoke 7 and is mounted on the mounting 22, as is a leaf spring 81 which acts as a thread clamp 8. The restraining spring 71, which is primarily to prevent the piecing thread from sliding away on the thread guide yoke, extends from its attachment point in the direction of the thread guide yoke 7 and crosses the latter.

The production of wrap yarn takes place as follows. The binding thread B (thread path B') running off from the binding thread bobbin 4 and the spinning fiber bundle emerging from the delivery roll pair of the drafting apparatus, pass through the rotating hollow spindle, the binding thread B being laid helically about the spinning fiber bundle S. The spinning fiber bundle S emerging from the pair of delivery rolls can therewith remain untwisted or acquire a false twist, in that it is brought, for example, into frictional contact with the hollow spindle 3. The wrap yarn produced is drawn off from the hollow spindle 3 by the takeoff roll pair 5, 50, and is wound up into the yarn bobbin SP.

If the spinning fiber bundle S breaks because of a disturbance, only the binding thread B is drawn out of the hollow spindle 3, the driving connection of the tangential belt 31 with the hollow spindle 3 is interrupted, and the latter is braked to a standstill. The spinning fiber bundle S, still continuously emerging from the delivery roll pair 1, 2 of the drafting apparatus, is seized by the suction air stream flowing in the suction tube 11 and is sucked away. In order to prevent further drawing of the binding thread B out of the hollow spindle 3, the binding thread is clamped and held fast by a thread clamp 51 between the hollow spindle 3 and the takeoff roll pair 5, 50. The binding thread is then parted between the hollow spindle 3 and the thread clamp 51, and the yarn bobbin SP is lifted from the grooved drum 6 which drives it. Appropriately, the stopping of the hollow spindle 3, the clamping of the binding thread and the lifting of the yarn bobbin SP is initiated by a yarn monitor 32.

Figure 2:
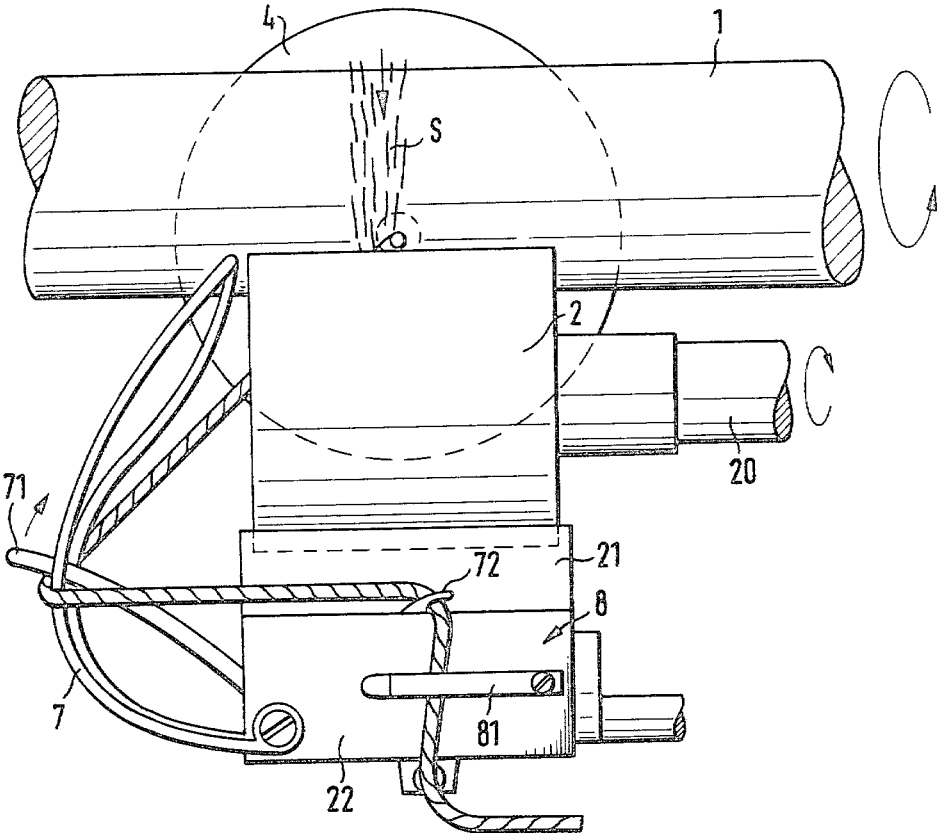
FIG. 2 is a plan view illustrating the pair of delivery rolls of the drafting apparatus with the pieceing thread laid out.

For piecing, a piecing thread is required which is laid out at the spinning point. In the present case, the wrap yarn wound up on the yarn bobbin SP is used together with the binding thread B as the piecing thread. The wrap yarn is unwound from the yarn bobbin SP to a length sufficient for piecing, passed in front of the takeoff rolls 5, 50 which continue to rotate, and is drawn through the hollow spindle 3, entraining the binding thread B which is still in the hollow spindle 3. The wrap yarn and the binding thread B are then laid in a loop around the thread guide yoke 7, the restraining spring 71 projecting above it and a deflecting pin 72, and are laid in the thread clamp 8 (FIG. 2). In this connection, it is necessary that, seen in the direction towards the delivery roll pair, a free thread length corresponding to the delivery speed of the delivery roll pair 1, 2 is present in front of the thread clamp 8. The free thread length should be at least 10% of the delivered yarn length/sec.

The hollow spindle 3 is now set in operation again so that a false twist is produced and the binding thread B is wound about the wrap yarn. Later starting of the thread bobbin SP on the grooved drum 6, takeoff of yarn from the hollow spindle 3 begins. Since the thread clamp 8 exerts a braking force on the piecing thread, the latter is tensioned and is thus able to overcome the restraining force of the restraining spring 71. The restraining spring 71 moves as shown by the arrow in FIG. 2 because of the yarn tension in the direction of the pressure roller 2 and releases the piecing thread so that it can slide along the thread guide yoke 7 and then runs into the nip between the pressure roller 2 and the bottom roller 1, where it unites with the spinning fiber bundle S. The yarn tension produced has the effect, among others, that the piecing thread moves into the nip between the takeoff rolls 5, 50.

Variants from the piecing process as described are possible. Thus, for example, the thread bobbin SP can be changed after the piecing thread has been laid out at the spinning point, as described above, and slidably clamped in the thread clamp 8. For this, the piecing thread is cut between the takeoff roller pair 5, 50 and the yarn bobbin SP and the yarn end, after the yarn bobbin SP has been changed for an empty one and the hollow spindle has been set in operation, is introduced manually into the nip of the takeoff rolls 5, 50 or, as in FIGS. 1 and 2, first into a suction duct 9. The suction duct 9, which when inoperative is suspended on a mounting and is movable to different spinning positions, makes it possible to suck away the piecing thread whereby a thick place which is formed during piecing-up is removed so that a later yarn cleaning can be eliminated. The suction duct 9 is moved in the direction of the arrow in FIG. 3, so that the piecing thread reaches the nip of the takeoff rolls 5, 50 which draw it under tension from the hollow spindle 3 so that it runs in, as described above, to the nip of the delivery rolls 1, 2 and unites there with the spinning fiber bundle S. When the thick place arising from piecing is sucked away, the wrap yarn emerging from the takeoff rolls 5, 50 is fed to the bobbin driven by the grooved drum 6. Of course, the piecing thread can also be sucked away when the yarn bobbin SP is not changed.

Figure 3:
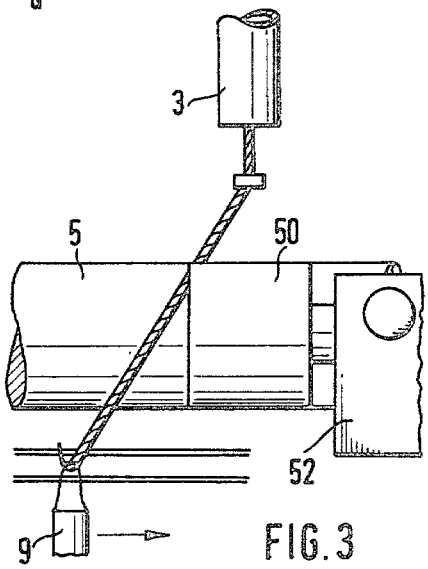
FIG. 3 is an enlarged front view showing the takeoff rolls with the piecing thread laid out.
Figure 4:
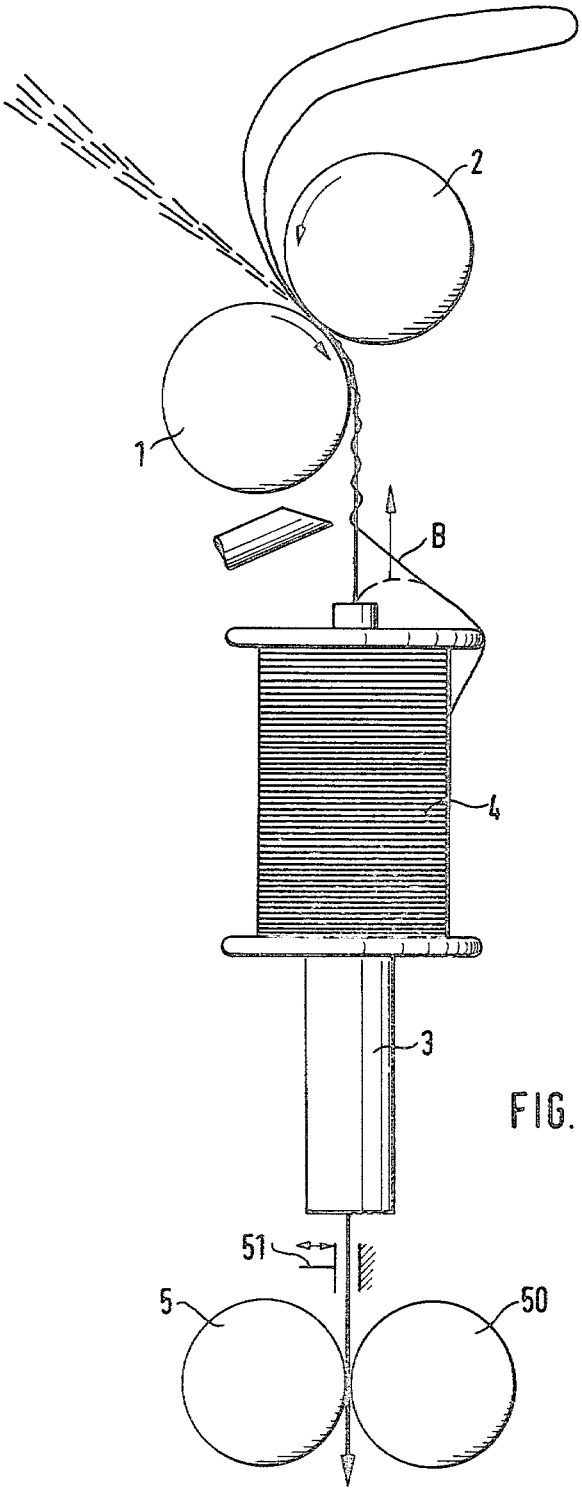
FIG. 4 is a side view of a modified form of the invention showing a further apparatus for production of a wrap yarn using the binding thread as piecing thread.

The piecing process shown in FIG. 4 differs from that described in connection with FIGS. 1 through 3 solely in that only the binding thread B is used as the piecing thread. The binding yarn B, which is held fast in the thread clamp 51 after a break of the spinning fiber bundle S is drawn in the direction of the delivery rolls 1, 2, as shown by the arrow so that it is wound off from the binding thread bobbin 4 and forms a thread loop which is guided around the thread guide yoke shown in FIG. 2, the restraining spring 71, and the deflecting pin 72, and is laid into the yarn clamp 8. The free yarn end must also have a length in front of the thread clamp corresponding to the delivery speed of the delivery rolls 1, 2. Piecing takes place in the manner described above; suction may expediently be provided for the piecing yarn.

In a further variation of the piecing process, an auxiliary thread of suitable length is used as the piecing thread, and is drawn through the hollow spindle 3 in the direction towards the takeoff roll pair 5, 50 or towards the delivery roll pair 1, 2. One end of the auxiliary thread is then introduced, as described above, into the yarn clamp 8 above the pair of delivery rolls, and the other end is introduced into the suction duct 9. The pieces of auxiliary thread can be placed in readiness in a container.

The invention has been described in connection with a wrapping apparatus with a rotating hollow spindle. It can also be used, however, with a wrapping apparatus in which the hollow spindle is non-rotatably fastened in the machine frame and the binding thread bobbin, mounted rotatably on the hollow spindle, is driven. In this case, the driving connection with the binding thread bobbin is interrupted when a yarn break occurs, as set out above, and the binding thread bobbin is set in operation again after laying out of the piecing thread.

What is claimed is:

1. A process for piecing-up a wrap yarn being produced on an apparatus including, a rotating hollow spindle through which a spinning fiber bundle is being delivered from a pair of delivery rolls, a binding thread running from a binding thread bobbin, and a yarn bobbin receiving said wrap yarn from said hollow spindle, said process comprising:

stopping the rotation of said hollow spindle, said binding thread bobbin and said yarn bobbin responsive to a break in said wrap yarn;

introducing a piecing thread through said hollow spindle and slidingly clamping said piecing thread above said pair of delivery rolls;

introducing said piecing thread into the nip of said pair of delivery rolls uniting said piecing thread with said spinning fiber bundle, restarting the rotation of said hollow spindle and said binding thread bobbin and drawing said pieced thread out of said hollow spindle overcoming clamping of said piecing thread.

2. The process as set forth in claim 1 further comprising:

said piecing thread being said wrap yarn produced.

3. The process as set forth in claim 1 further comprising:

said piecing thread being said binding thread.

4. The process as set forth in claim 1 further comprising:

said piecing thread being drawn through said hollow spindle by suction and sucked off.

5. An apparatus for piecing up wrap yarn being produced on a machine including, a rotating hollow spindle, a pair of delivery rolls delivering a spinning fiber bundle to said rotating hollow spindle, a binding thread bobbin carried on said hollow spindle feeding a binding thread to said spinning fiber bundle for being wrapped therearound producing said wrap yarn, a windup device and a pair of takeoff rolls withdrawing said wrap yarn from said hollow spindle and delivering said wrap yarn to said windup device, said apparatus comprising:

a thread clamp means (8) carried between said hollow spindle and said pair of delivery rolls;

a thread guide yoke (7) carried adjacent said pair of delivery rolls, and a piecing thread drawn through said hollow spindle having a free end extending under said clamp means and over said thread guide yoke to the nip of said delivery rolls for being joined to said fiber bundle being fed to said delivery rolls.

6. The apparatus as set forth in claim 5 further comprising:

a restraining spring (71) means maintaining said piecing thread in contact with said thread guide yoke.

7. The apparatus as set forth in claim 5 further comprising:

a suction means carried between said hollow spindle and said windup device for sucking off said piecing thread.

8. A process for piecing-up a wrap yarn being produced on an apparatus including, a hollow spindle through which a spinning fiber bundle is being delivered from a pair of delivery rolls, a binding thread running from a rotating binding thread bobbin, and a yarn bobbin receiving said wrap yarn from said hollow spindle, said process comprising:

stopping the rotation of said binding thread bobbin and said yarn bobbin responsive to a break in said wrap yarn;

introducing a piecing thread through said hollow spindle and slidingly clamping said piecing thread above said pair of delivery rolls;

introducing said piecing thread into the nip of said pair of delivery rolls uniting said piecing thread with said spinning fiber bundle, restarting the rotation of said binding thread bobbin and drawing said pieced thread out of said hollow spindle overcoming clamping of said piecing thread.

9. An apparatus for piecing up wrap yarn being produced on a machine including, a hollow spindle, a pair of delivery rolls delivering a spinning fiber bundle to said hollow spindle, a rotating binding thread bobbin carried on said hollow spindle feeding a binding thread to said spinning fiber bundle for being wrapped therearound producing said wrap yarn, a windup device and a pair of takeoff rolls withdrawing said wrap yarn from said hollow spindle and delivering said wrap yarn to said windup device, said apparatus comprising:

a thread clamp means (8) carried between said hollow spindle and said pair of delivery rolls;

a thread guide yoke (7) carried adjacent said pair of delivery rolls, and a piecing thread drawn through said hollow spindle having a free end extending under said clamp means and over said thread guide yoke to the nip of said delivery rolls for being joined to said fiber bundle being fed to said delivery rolls.

* * * * *